US005444873A

United States Patent [19]

Levin

[11] Patent Number: 5,444,873

[45] Date of Patent: Aug. 29, 1995

[54] DISPOSABLE PROTECTIVE GOWNS

[75] Inventor: Allan Levin, Mundelein, Ill.

[73] Assignee: Medline Industries, Inc., Mundelein, Ill.

[21] Appl. No.: 195,542

[22] Filed: Feb. 14, 1994

[51] Int. Cl.[6] ..... A41D 13/00

[52] U.S. Cl. ..... 2/114; 2/52; 2/69; 2/48; 2/51; 2/275

[58] Field of Search ..... 2/46, 48, 49, 49.1, 2/49.2, 49.3, 49.4, 49.5, 50, 51, 52, 104, 105, 106, 114, 75, 80, 912, 913, 914, 915, 275, 243.1

[56] References Cited

U.S. PATENT DOCUMENTS

| | | | |
|---|---|---|---|
| 582,145 | 5/1897 | Oppenheim | 2/275 |
| 2,720,655 | 10/1955 | Simon et al. | 2/275 |
| 3,353,189 | 11/1967 | Zimmon | 2/114 |
| 3,727,236 | 4/1973 | Lloyd et al. | 2/51 |
| 4,829,602 | 5/1989 | Harreld et al. | 2/51 |
| 4,837,860 | 6/1989 | Roberts et al. | 2/51 |
| 5,033,115 | 7/1991 | Bowling et al. | 2/48 X |

*Primary Examiner*—Jeanette E. Chapman
*Attorney, Agent, or Firm*—Laff, Whitesel, Conte & Saret, Ltd.

[57] ABSTRACT

A disposable protective gown having a body portion with an upper part formed to extend over the shoulders of the wearer of the gown. The upper part includes a centrally located aperture for passage of the wearer's head. A pair of sleeves extend outwardly from opposite sides of the upper part and each comprise a generally conical member that is attached at one end along 360 degrees of its circumference to the upper part. The orientation of each sleeve is provided by an integral thumb loop at the hand end of the sleeve. A heat seal weld joins the sleeve and body portion at a welded interface which extends along 330 degrees of the circumference of the base of the sleeves. Another heat seal extends along the length of each of the sleeves until it intersects and extends a little beyond the 360 degree weld to form as somewhat "L-shaped" seal for added strength.

5 Claims, 2 Drawing Sheets

DISPOSABLE PROTECTIVE GOWNS

FIELD OF THE INVENTION

This invention relates to disposable protective gowns. More particularly, this invention relates to disposable protective gowns having low cost designs with a minimal number of panels and heat sealed seams.

BACKGROUND OF THE INVENTION

Disposable protective gowns are commonly used in hospitals, clinics and other diagnostic facilities. For example, protective gowns are often worn by patients to protect against contamination, infection, and disease and further to offer a means of privacy. The current protective gowns generally include a multiplicity of interconnected panels with numerous seams and require extensive cutting and fitting for their assembly. As a result of their complex designs, production costs of these protective gowns are substantial as compared to the production costs of less complex designs.

In addition, many of the present protective gowns inadequately cover and protect the shoulder area and further tend to bunch under the armpits or ride up and twist on the arms of the user. Moreover, many of the known protective gowns inadequately cover larger or heavier patients, especially in the leg area, or preclude leg movement beneath the gown without undue exposure of the user's body.

A variety of these known protective gowns are disclosed in U.S. Pat. Nos. 3,464,063; 3,911,499; 4,608,719; 4,631,756; 4,829,602; and 4,951,318. Other prior patents which are of interest include U.S. Pat. Nos. 287,546; 699,238; 2,173,344; 2,282,547; 2,430,745; 2,554,380; 2,686,913; 2,918,677; 3,452,363; 3,719,955; 4,475,250; 4,493,116; 4,523,336; 4,532,655; 4,561,126; 4,587,671; Des. 115,086; Des. 232,134; and Des. 233,275.

Therefore, while the prior art protective gowns disclosed in these patents may, is some instances, prevent contamination, infection, and disease, they are complicated to assemble, expensive to use, and often inadequate for prolonged use, especially by heavier patients.

Accordingly, an object of the present invention is to provide new and improved disposable protective gowns which overcome the above-described problems. Here, an object is to provide a protective gown which has both a low cost design and simple assembly requirements. In particular, an object is to provide a protective gown which includes sleeves that are more securely attached to the body portion of the gown and with fewer seams. Moreover, another object is to provide a protective gown which provides greater coverage and protection in the shoulder area of the user and which accommodates heavier patients.

SUMMARY OF THE INVENTION

In keeping with an aspect of the invention, these and other objects are accomplished, in a preferred embodiment, by a disposable protective gown having, in part, a body portion with an upper part formed to extend over the shoulders of the user of the gown and a pair of sleeves extending outwardly from opposite sides of the upper part. The body portion is generally somewhat rectangular and comprises a single unitary panel. The sleeves are generally conical or frusto-triangular and include a first continuous heat seal which extends across the entire length of each of the sleeves. The sleeves further include a second continuous heat seal which attaches the sleeves at the shoulder end along 360 degrees of their circumference to the upper part of the body portion of the gown to provide maximum coverage and protection of the shoulder area of the user. The second continuous heat seal overlaps with the first continuous heat seal and with an "L-shaped" seal for strength additionally protecting the user from exposure.

In addition, the sleeves include means for maintaining their orientation on the user's arm. The orientation means preferably include a thumb loop that is integrally formed on the hand end of each of the sleeves and which engages the base of the thumb adjacent the forefinger of the user.

The protective gown further includes a centrally located aperture on the upper part of the body portion for enabling a passage of the user's head. At least one cut line is adjacent the head aperture for facilitating a tearing of the gown away from the user. Means for securing the body portion to the user (such as ties, belt, or the like) are centrally located on the body portion and are preferably heat sealed to the body portion of the gown.

Thus, the invention provides a disposable protective gown that is simple in design and which includes sleeves that are more securely attached to the body portion of the gown and with fewer seams for providing greater coverage and protection to the shoulder area of the user. Specifically, the protective gown requires very little cutting because it requires only three pieces of material for forming the body of the gown and additionally two pieces of material for the sleeves. Moreover, the protective gown requires only four seams to form and secure the sleeves to the body portion of the gown and, therefore, lends itself to manufacture by people with no special training or experience. In addition to the foregoing, the inventive protective gown accommodates heavier users.

BRIEF DESCRIPTION OF THE DRAWINGS

The above, as well as other objects and advantages of the invention, will become apparent from the following detailed description of the preferred embodiments, reference being made to the accompanying drawings, in which.

DETAILED DESCRIPTION OF THE INVENTION

Figure 6:
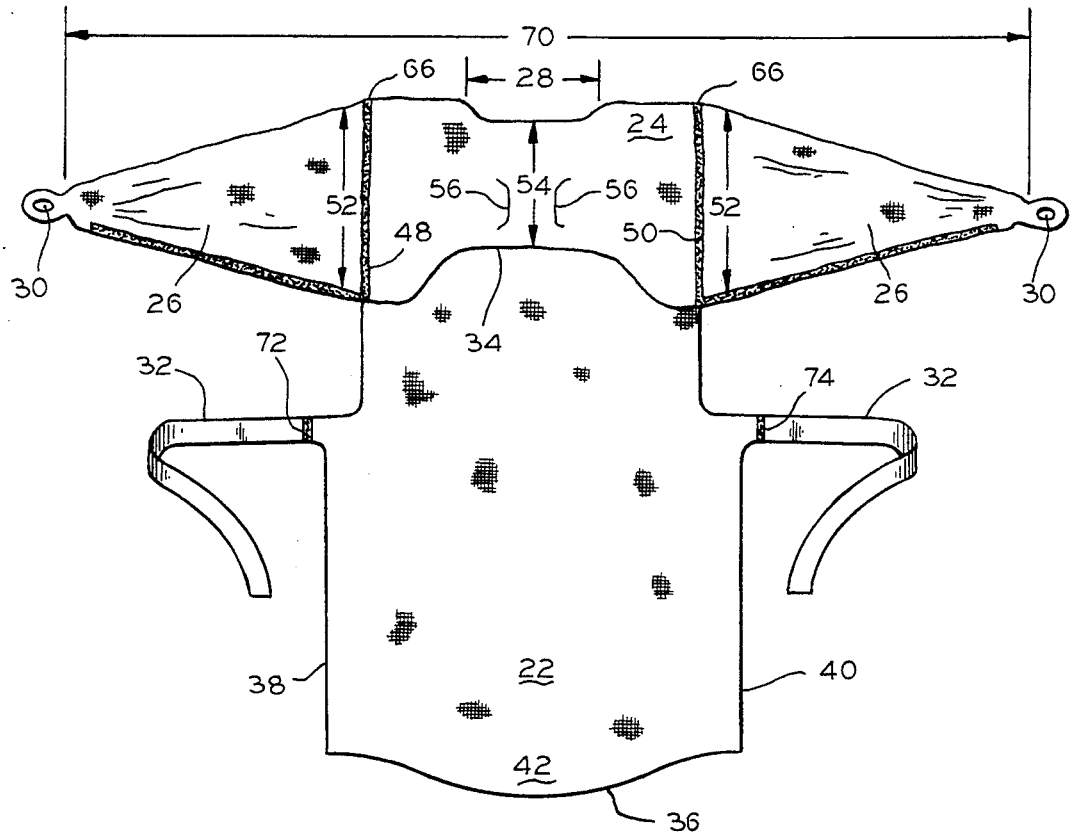
FIG. 6 is a plan view of the completed protective gown.

A disposable protective gown 20 (FIG. 6) includes a body portion 22 with an upper part 24 formed to extend over the shoulders of the user of the gown and a pair of sleeves 26 extending outwardly from opposite sides of upper part 24. An aperture 28 is centrally located on upper part of portion 22 to give access for a passage of the user's head. Means 30 for maintaining the orientation of sleeves 26 are located on the free ends of the sleeves. In addition, tie means 32 for securing the body portion 22 around the user are attached to opposite sides of the body portion.

Body portion 22 is a single unitary panel that is generally rectangular with a top edge 34, a bottom edge 36, and first and second sides, 38 and 40, respectively. The front of body portion 22 includes a shirt-tail portion 42 which extends into and forms the sides of the gown to cover the wearer and allow greater leg movement beneath the gown without exposure of the user's body. Moreover, top edge 34 of the neck opening may be inwardly contoured in the central portion of upper part 24 to facilitate a removal of the gown from the user.

Figure 1:
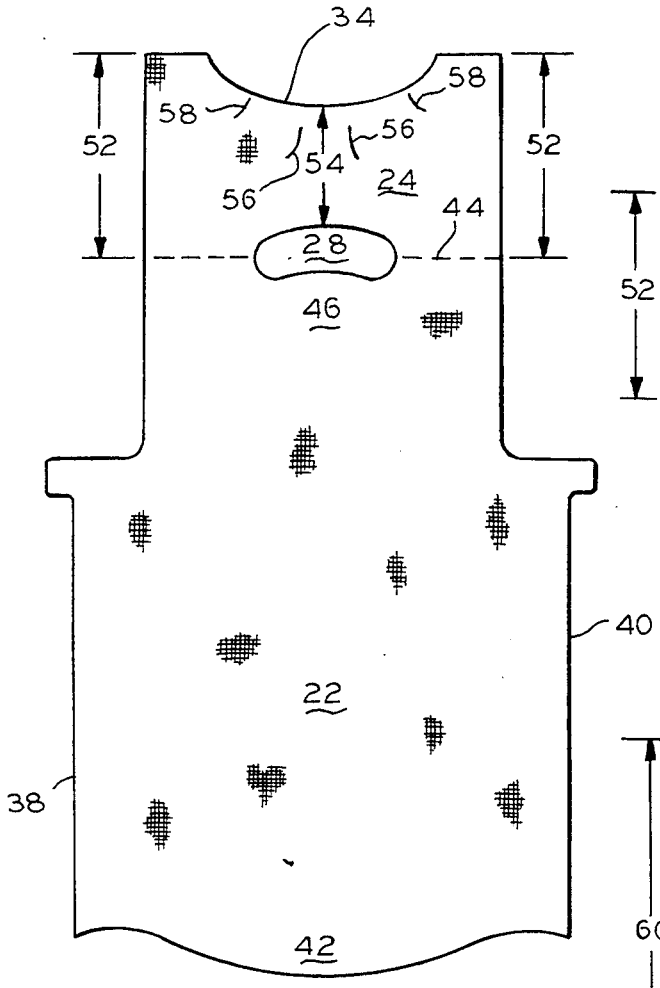
FIG. 1 is a plan view of the body panel of the inventive protective gown.

Body portion 22 is approximately 36-inches wide and approximately 44-inches long. Body portion 22 is folded over on itself, along a fold line 44 (FIG. 1) to form that part of the gown which extends over the user's shoulders.

Figure 2:
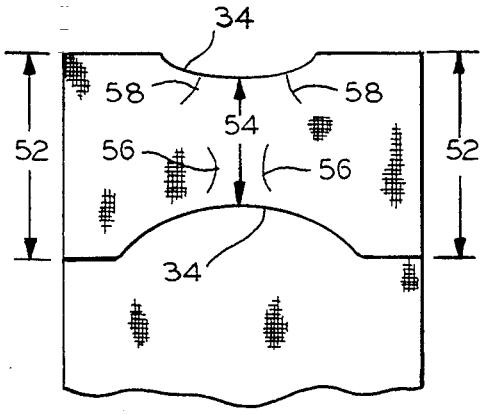
FIG. 2 is a plan view of the body portion of FIG. 1, illustrating a folding of the upper part to form a head opening portion.

Head aperture 28 is centrally positioned on the fold line 44 between upper part 24 and body portion 22, and is approximately 9-inches long and 2-3-inches wide. A slight rise 46 is built into the head aperture 28 in order to cover the hollow at the junction between the front of the neck and the chest. In addition, approximately 9-inches of material separates head aperture 28 from shoulder seams 48, 50 (FIG. 5), respectively, while approximately 12-inches of material is folded over at 52. At least one cut line 56 is located adjacent head aperture 28 to facilitate removal by tearing the gown from the wearer. In the preferred embodiment, two semi-circular apertures 56 are located in upper part 24. Furthermore, there may be additional cut lines 58 (FIG. 2) adjacent the semi-circular edge of the head aperture 48, which help initiate the tearing of the gown during its removal.

Figure 3:
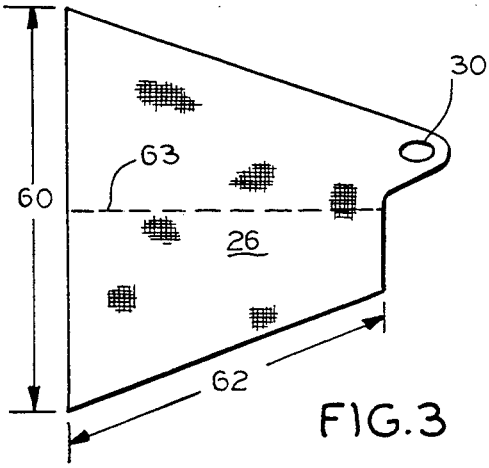
FIG. 3 is a plan view of the material used to form the sleeve in the preferred embodiment.
Figure 4:
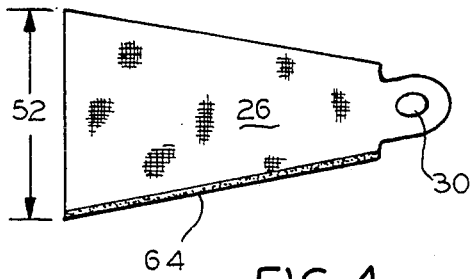
FIG. 4 is a plan view of the material used to form the sleeve, illustrating the manner in which it is folded.

Sleeves 26 are generally shaped like truncated cones and are formed from a single piece of material (FIG. 3) that includes an approximately 24-inch base 60, and two approximately 20-inch sides 62. Sleeves 26 are mirror images of one another and are attached at 52 to folded over upper part 24 and body portion 22. Prior to their attachment, sleeves 26 are formed (FIG. 4) by folding the material over on itself along fold line 63. Next, the side of the body portion and end of the folded sleeve material are heat sealed together along their entire length with a first continuous seal 64 (FIG. 4). The hand end of the sleeve is reduced by about half and is approximately 6-inches wide.

Figure 5:
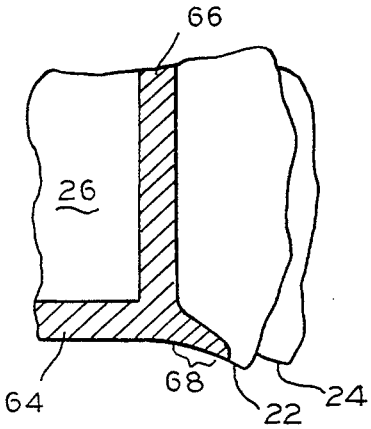
FIG. 5 is an enlarged view of the heat seal weld at the under arm junction of the shoulder and sleeve welds.

Subsequent to folding, sleeves 26 are then attached to upper part 24 and body portion 22 by a second continuous seal 66 (FIG. 6) which extends around 360 degrees of the circumference of the base 52 of the sleeves for completely sealing the sleeves to the gown. FIG. 5 shows the under arm function of the shoulder and sleeve welds where the sleeve seam weld 64 extends beyond the shoulder seam weld 66 for a distance 68 which is the toe of a somewhat L-shaped seam weld formed jointly by the welds 66, 68. As a consequence of this 360 degree L-shaped attachment, the second continuous seal 66 overlaps with the first continuous seal 64 for providing an additional strength protecting the user from exposure.

Once the sleeves are attached, the span of both sleeves 26 and body 22, when extended, is approximately 66-inches. Moreover, after attachment to gown 20, fold line 63 of sleeves 26, is coplanar with the center of head aperture 28 and is approximately 44–48 inches from bottom edge 36 of body portion 22.

In conjunction with the first and second continuous heat seals, each of the sleeves 26 include means 30 for maintaining their natural orientation on the user's arm. These orientation means are preferably in the form of a thumb loop 30 which is integrally formed with the top side of the sleeves. The loop engages the base of the thumb adjacent the forefinger of the user.

Securing means 32 are attached to opposite sides of body portion 22 and are preferably joined to body portion 22 by a third and fourth heat weld seam, 72 and 74, respectively. Securing means 32 are each approximately $2\frac{1}{2}$ inches in width and 27 inches in length but may be adjusted in both their width and length as deemed necessary.

Thus, the protective gown includes a continuous heat seal at the sleeve-body portion interface which extends along 360 degrees of the circumference of the base of the sleeves. This configuration results in completely sealing the sleeves to the gown and provides maximum coverage and protection to the shoulder area of the user. Moreover, the circumferentially extending heat seal overlaps with another continuous heat seal that extends across the length of the sleeves and projects there beyond in order to form an L-shaped seam for additionally protecting the user from exposure.

Therefore, the invention provides a protective gown with a minimal number of pieces and heat seams that simplifies the assembly requirements and lowers the production costs by enabling people with no special training or experience to manufacture the gown. Moreover, each of the above embodiments provides a protective gown which includes sleeves that are more securely attached to the body portion of the gown and which provide maximum coverage and protection of the shoulder area of the user.

Those who are skilled in the art will readily perceive how to modify the invention. Therefore, the appended claims are to be construed to cover all equivalent structures which fall within the true scope and spirit of the invention.

The invention claimed is:

1. A disposable protective gown comprising:

a body portion having an upper part formed to extend over the shoulders of the user of the gown, said upper part having a centrally located somewhat semicircular head aperture for passage of the wearer's head, a perimeter of said semicircular head aperture having a rise at the front of said gown in order to cover the junction between the front of the neck and chest of the wearer;

a pair of sleeves extending outwardly from opposite sides of said upper part, each of said sleeves comprising a somewhat generally conical member that is attached to the gown body portion by a heat weld seam extending around 360 degrees of a circumference of a sleeve opening in said upper part of said of said body portion, each of said sleeves including a single continuous heat weld seam which extends along the entire length of the sleeves, intersects with and projects somewhat beyond said 360 degree to form a generally L-shaped seam;

means for maintaining the orientation of each sleeve located at an opposite end thereof; and means for securing the body portion of the wearer, said securing means being a pair of belts attached to opposite sides of said body portion.

2. The disposable protective gown of claim 1 wherein said body portion is a single unitary panel that is generally rectangular.

3. The protective gown of claim 1 wherein said orientation means comprise an integrally formed loop that engages the base of the thumb adjacent the forefinger of the wearer.

4. The protective gown of claim 1 wherein said upper part of said body portion includes at least one cut line adjacent the head aperture for facilitating removal of the gown from the wearer.

5. A disposable protective gown comprising:

a body portion having an upper part formed to extend over the shoulders of the wearer of the gown, said upper part having a centrally located aperture for passage of the wearer's head, said upper part of said body portion further including at least one cut line adjacent the head aperture for facilitating removal of the gown by tearing it away from the wearer, a rise in the perimeter of said aperture for covering the junction between the front of the neck and chest of the wearer;

a pair of sleeves extending outwardly from opposite sides of said upper part, each of said sleeves comprising a generally conical member formed with a single longitudinally heat welded seal extending along the length of said sleeve, one end of each of said sleeves being secured to said body portion along a heat weld seam around 360 degrees of its circumference;

means for maintaining the orientation of each sleeve located at an opposite end thereof, said orientation means comprising an integrally formed loop that engages the base of the thumb adjacent the forefinger of the wearer; and means for securing the body portion on the wearer, said securing means being two belts respectively attached to opposite sides of said body portion;

wherein each of said sleeves includes said single heat welded seal extending across the length of the sleeves, to and beyond said 360 degree heat weld seam, said first heat seal and said 360 degree seam forming a generally L-shaped seam.

* * * * *